US010619872B2

(12) United States Patent
Mills et al.

(10) Patent No.: US 10,619,872 B2
(45) Date of Patent: Apr. 14, 2020

(54) APPARATUS AND METHOD FOR PROVIDING SELECTIVE FAN OR VENT COOLING

(71) Applicants: Kirk Mills, El Dorado Hills, CA (US); Kimberley Mills, El Dorado Hills, CA (US)

(72) Inventors: Kirk Mills, El Dorado Hills, CA (US); Kimberley Mills, El Dorado Hills, CA (US)

(73) Assignee: CENTRAVENT, llc, El Dorado Hills, CA (US)

( * ) Notice: Subject to any disclaimer, the term of this patent is extended or adjusted under 35 U.S.C. 154(b) by 185 days.

(21) Appl. No.: 15/419,654

(22) Filed: Jan. 30, 2017

(65) Prior Publication Data

US 2017/0363309 A1 Dec. 21, 2017

Related U.S. Application Data

(60) Provisional application No. 62/392,958, filed on Jun. 15, 2016.

(51) Int. Cl.

| | |
|---|---|
| ***F24F 7/06*** | (2006.01) |
| ***F24F 13/14*** | (2006.01) |
| ***F24F 11/79*** | (2018.01) |
| ***F24F 11/30*** | (2018.01) |
| ***F24F 110/10*** | (2018.01) |
| ***F24F 11/88*** | (2018.01) |
| ***F24F 11/84*** | (2018.01) |

(52) U.S. Cl.

CPC ..... *F24F 7/065* (2013.01); *F24F 11/30* (2018.01); *F24F 11/79* (2018.01); *F24F 13/14* (2013.01); *F24F 11/84* (2018.01); *F24F 11/88* (2018.01); *F24F 2110/10* (2018.01)

(58) Field of Classification Search

USPC ..... 454/229, 234, 354, 347, 358; 700/276, 700/277

See application file for complete search history.

(56) References Cited

U.S. PATENT DOCUMENTS

| | | | | |
|---|---|---|---|---|
| 1,924,489 A | | 8/1933 | Ferris | |
| 1,931,156 A | | 10/1933 | Persons | |
| 2,087,637 A | * | 7/1937 | Burt ..... | F24F 7/007 454/347 |
| 2,278,581 A | | 4/1942 | Macdougald | |
| 2,349,627 A | | 5/1944 | Kemmer | |

(Continued)

OTHER PUBLICATIONS

Scaringe, Bob,Ph.D., P.E. "Thermostatic Wiring Principles", Knowledgebase, QuikProducts (tm) by Mainstream Engineering Corporation, Rockledge FL (Year: 2011).*

*Primary Examiner* — Edelmira Bosques
*Assistant Examiner* — Frances F. Hamilton
(74) *Attorney, Agent, or Firm* — Jim H. Salter; Inventive Law Inc.

(57) ABSTRACT

An apparatus and method for providing selective fan or vent cooling are disclosed. An example embodiment includes: a return plenum box having a return box opening, a fan opening, and a return duct opening; a fan coupled to the fan opening; a controller coupled to the plenum box; and an adjustable damper coupled to a hinge point of the return plenum box, the damper being adjustable between a closed position, which blocks the fan opening and an open position that blocks the return duct opening.

16 Claims, 6 Drawing Sheets

(56) References Cited

U.S. PATENT DOCUMENTS 2,483,377 A 9/1949 Young
2,612,831 A 10/1952 Lohman, Jr.
2,668,491 A 2/1954 Gerlitz
2,770,955 A * 11/1956 Lundstrum ..... F24F 1/02 454/236
2,775,927 A * 1/1957 Wulle ..... F24F 13/068 285/148.19
2,875,678 A 3/1959 Wyley
4,253,153 A * 2/1981 Bitterli ..... F24F 3/153 700/277
4,261,255 A * 4/1981 Anderson ..... F24F 7/007 415/126
4,353,412 A * 10/1982 Krumhansl ..... F24D 11/0264 165/59
4,375,183 A 3/1983 Lynch
4,385,550 A 5/1983 Steiner
4,394,958 A * 7/1983 Whitney ..... F24F 13/1426 236/49.3
4,416,415 A 11/1983 Kolt
4,452,391 A * 6/1984 Chow ..... F24F 13/1426 236/49.3
4,501,194 A 2/1985 Brown
4,501,389 A 2/1985 Kolt
4,510,851 A 4/1985 Samosky
4,594,940 A 6/1986 Wolbrink
4,596,180 A 6/1986 Steiner
4,628,802 A 12/1986 Steiner
4,661,914 A * 4/1987 Mulokey ..... G05D 23/1905 165/212
4,766,806 A 8/1988 Tomiser, Jr.
4,779,518 A 10/1988 Artwick
4,784,049 A 11/1988 Steiner
4,939,986 A 7/1990 Turner
5,060,901 A 10/1991 Lathrop
5,318,474 A * 6/1994 Klassen ..... F24F 13/068 454/296
5,489,238 A * 2/1996 Asselbergs ..... F24F 7/013 454/329
6,135,878 A * 10/2000 Felsen ..... F24F 13/06 454/296
6,322,443 B1 * 11/2001 Jackson ..... F24F 7/065 415/213.1
6,471,582 B1 * 10/2002 Tucker ..... F24F 3/161 454/187
6,533,656 B2 3/2003 Hertel
6,752,713 B2 6/2004 Johnson, Jr.
6,802,770 B2 10/2004 Larson
6,979,169 B2 12/2005 Penlesky
7,128,303 B2 10/2006 Penlesky
7,347,774 B2 * 3/2008 Aronstam ..... F24F 11/0001 454/258
7,398,821 B2 7/2008 Rainer
7,455,500 B2 11/2008 Penlesky
7,497,774 B2 * 3/2009 Stevenson ..... F24F 7/065 454/341
7,731,477 B2 6/2010 Erni
7,774,102 B2 8/2010 Butler
7,891,573 B2 * 2/2011 Finkam ..... F24F 11/74 236/49.3
8,165,719 B2 4/2012 Kinney
8,245,947 B2 * 8/2012 Roderick ..... F24F 11/0001 236/49.3
8,543,244 B2 9/2013 Keeling
8,550,368 B2 10/2013 Butler
8,791,587 B2 7/2014 Smith, Jr.
9,261,283 B2 * 2/2016 Mulder ..... F24D 5/02
9,261,290 B2 2/2016 Storm
9,322,568 B2 4/2016 Aycock
9,338,810 B2 5/2016 Erickson
9,914,336 B2 * 3/2018 Smith ..... B60H 1/00278
2002/0112409 A1 8/2002 Knowles
2005/0087614 A1 * 4/2005 Ruise ..... F24F 7/06 236/49.3
2007/0145160 A1 * 6/2007 Martin ..... F24F 3/0442 236/49.3
2007/0167127 A1 * 7/2007 Wiley ..... F24F 13/0236 454/229
2008/0096482 A1 4/2008 Wettergren
2009/0013703 A1 1/2009 Werner
2009/0076658 A1 * 3/2009 Kinnis ..... F24F 11/0001 700/277
2009/0186572 A1 * 7/2009 Farrell ..... F24F 13/06 454/256
2011/0151766 A1 6/2011 Sherman
2011/0223850 A1 9/2011 Narayanamurthy
2012/0060956 A1 * 3/2012 Zwiernik ..... F24F 13/0236 137/798
2012/0190294 A1 * 7/2012 Heidel ..... F24F 7/06 454/343
2013/0166075 A1 6/2013 Castillo
2013/0244563 A1 9/2013 Noteboom
2013/0268124 A1 * 10/2013 Matsuoka ..... G05B 15/02 700/276
2014/0065939 A1 * 3/2014 Dietz ..... G05D 7/0658 454/229
2014/0206278 A1 7/2014 Stevenson
2015/0276253 A1 * 10/2015 Montalvo ..... G06Q 10/06 700/276
2016/0054016 A1 2/2016 Takahashi
2016/0076784 A1 * 3/2016 Dietz ..... F24F 11/0001 454/239

* cited by examiner

APPARATUS AND METHOD FOR PROVIDING SELECTIVE FAN OR VENT COOLING

PRIORITY PATENT APPLICATION

This is a non-provisional patent application claiming priority to U.S. provisional patent application Ser. No. 62/392,958; filed Jun. 15, 2016. This non-provisional patent application claims priority to the referenced provisional patent application. The entire disclosure of the referenced patent application is considered part of the disclosure of the present application and is hereby incorporated by reference herein in its entirety.

TECHNICAL FIELD

The disclosed subject matter relates to the field of heating, cooling and ventilating equipment for structures, and particularly although not exclusively, to an apparatus and method for providing selective fan or vent cooling.

COPYRIGHT

A portion of the disclosure of this patent document contains material that is subject to copyright protection. The copyright owner has no objection to the facsimile reproduction of the patent document or the patent disclosure, as it appears in the Patent and Trademark Office patent files or records, but otherwise reserves all copyright rights whatsoever. The following notice applies to the disclosure provided herein and to the drawings that form a part of this document: Copyright 2015-2017, Kirk and Kimberley Mills; All Rights Reserved.

BACKGROUND

Heating and cooling the space in residential and commercial buildings accounts for a primary share of building energy consumption. Existing buildings use either an air conditioning system or a whole house fan for cooling and ventilating residential and commercial building structures. Traditional air conditioning systems function by altering the temperature and humidity of the air and then pump the treated air throughout the structure. The thermostat powers on the air conditioner until the structure reaches a set point temperature. While effective at conditioning the air, such traditional air conditioning systems are costly to run and not energy efficient. Additionally, when the outside ambient air temperature is lower than the internal air temperature, outside ambient air could instead be used to effectively cool the structure, reducing the need to run a costly air conditioning system. Further, air conditioning systems merely circulate air located within a building, and do not bring any outside air, so any harmful environmental elements (e.g. dust, disease, chemicals) remain within the building.

In response to such problems, some structures instead use whole house fans to force air through the structure. Whole house fans consist of one or more exhaust fans, typically placed in the attic or an upper floor, and function by creating a negative pressure inside of the structure to draw cooler air in from the outside. The cooler outside air is forced up through the ceiling into the attic where the air is exhausted out through a vent. Louvered shutters are often placed over the vent to prevent cooled or heated air from escaping when the fan is not in use. Whole house systems move large amounts of air and allow for the entire structure air volume to be recycled with multiple air exchanges per hour, removing latent heat within the structure. Traditional whole house fans are installed on the attic floor such that they directly contact the ceiling of the structure. As such, the large capacity whole house fans, necessary to create sufficient negative pressure to draw the cooler air inside in the structure, can create undesirable noise and vibrations that penetrate the occupied space of the building. Advantageously, these systems require less energy than air conditioning systems and can reduce the need for air conditioning and therefore reduce structure energy consumption while still providing a comfortable space. However, such whole house fans require open windows to serve as intake air vents. Thus, the user is required to manually control the air flow. The opened windows, however, can allow in dust, pollen and other pollutants from the exterior incoming air. Additionally, the cooling capabilities of whole house fans are limited by the ambient outside air. Whole house fans are incapable of lowering the temperature and humidity of the air drawn into the building. Accordingly, whole house fans are not effective at cooling the space when the outside ambient air temperature is higher than the internal air temperature. Thus, a user operating the whole house fan under unsuitable conditions may actually heat the space when they intended to use the fan to cool the space.

SUMMARY

The whole house cooling system of an example embodiment comprises a whole house fan plenum box with damper and actuator. With a flip of a switch, a circuit board or controller of the example embodiment can shut down the heating, ventilating, and air conditioning (HVAC) unit and then the actuator can move the damper from the closed position to the open position. After a short time delay, the whole house fan(s) can energize, pulling air from open windows of the structure through the plenum and blowing the air through interstitial regions (e.g., the attic), thereby purging the heat out of the structure. An example embodiment is designed to deactivate the central HVAC system before opening the damper to protect the HVAC system. In the event of a power outage, the damper is configured to automatically spring closed.

The whole house cooling system of an example embodiment is configured to fit inside most standard return air boxes, thereby eliminating the need to cut in an unsightly hole in the ceiling and eliminating the need to re-engineer the trusses of the structure. An example embodiment includes a motorized damper system that will adapt to most standard central HVAC systems and will not harm the system. The example embodiment includes an automated circuit board and control system, which when turned on, will cause the damper to activate closing off the return duct to the central HVAC system and opening the damper to a whole house fan included with the whole house cooling system. Once activated, the whole house cooling system of the example embodiment can pull a significant volume of air (e.g., 3000-3500 cfm) through the structure from the outside. As a result, the interior of the structure cools down (when the air is cooler outside). Blowing cool air through the interstitial regions (e.g., the attic) of the structure relieves the structure of the unwanted heat absorbed in the attic from a hot day. This whole house cooling system of an example embodiment uses the cool air from the outside to cool the structure at a fraction the typical central HVAC costs.

The whole house cooling system of an example embodiment can provide several benefits. Firstly, the example embodiment can effectively purge heat out of the interstitial regions (e.g., the attic). Secondly, the example embodiment can bring cooler air from the outside (when the outside air is cooler) and cool the structure without the need to run the air conditioning system. Thus, the whole house cooling system of an example embodiment reduces energy costs. Additionally, the whole house cooling system of an example embodiment can be conveniently installed without structural modifications. There is no need to install a big, unsightly fan in the ceiling of the structure. The example embodiment fits in most standard return air/filter boxes.

BRIEF DESCRIPTION OF THE DRAWINGS

Embodiments are illustrated by way of example and not limitation in the figures of the accompanying drawings, in which.

DETAILED DESCRIPTION

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

According to various example embodiments of the disclosed subject matter as described herein, there is disclosed, illustrated, and claimed an apparatus and method for providing selective fan or vent cooling. The example embodiments disclosed herein provide an apparatus, system, and method implemented in a whole house cooling system. The whole house cooling system of an example embodiment comprises a whole house fan plenum box with damper and actuator. A controller of the example embodiment can shut down the heating, ventilating, and air conditioning (HVAC) unit and then the actuator can move the damper from the closed position to the open position. The whole house fan(s) can pull air from open windows of the structure through the plenum and blowing the air through the interstitial regions (e.g., the attic), thereby purging the heat out of the structure.

Figure 1:
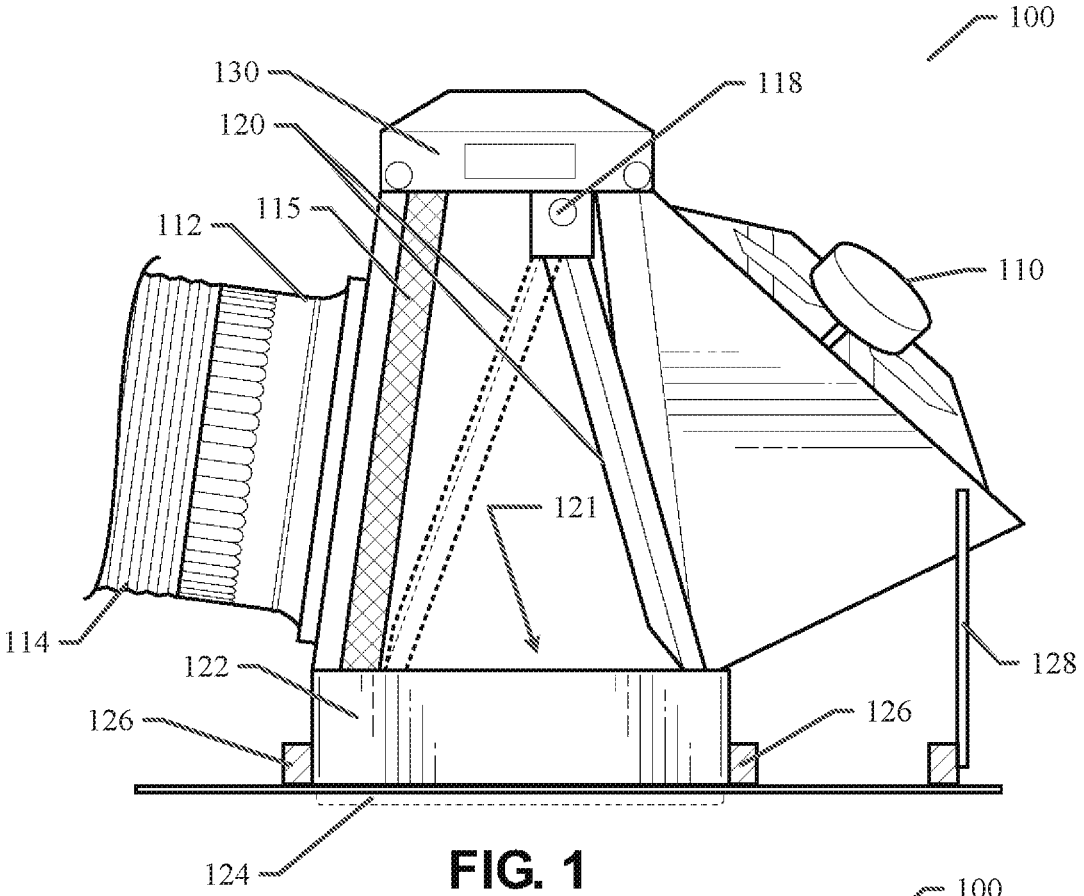
FIGS. 1 through 3 illustrate an example embodiment of the whole house cooling system with a return plenum box, actuated damper, and side-mounted fan.
Figure 2:
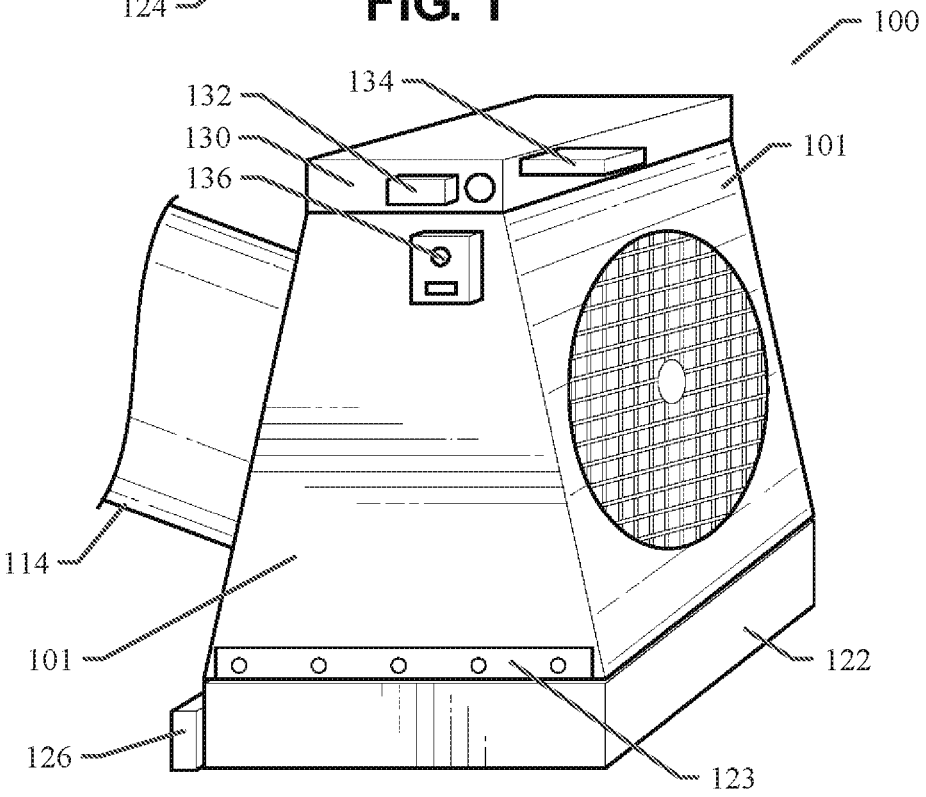
Figure 3:
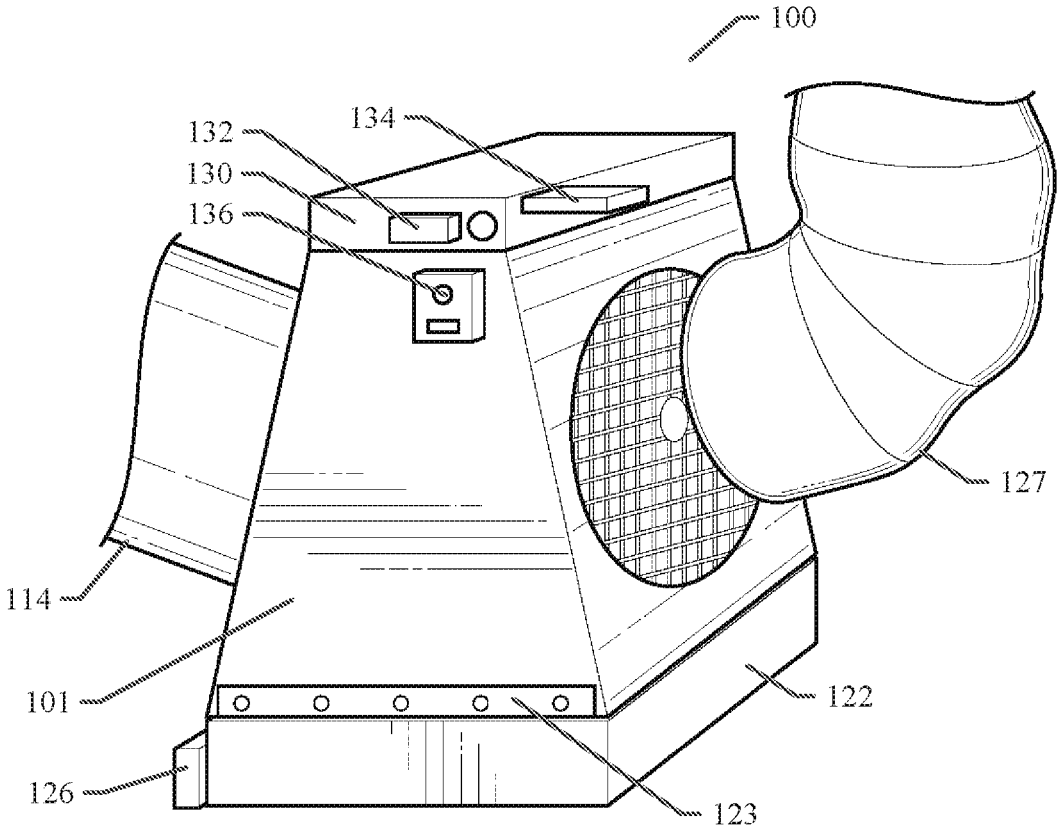

Referring now to FIGS. 1 through 3, an example embodiment of the whole house cooling system 100 with a return plenum box 101, actuated damper 120, and side-mounted fan 110 is illustrated. In the example embodiment, the whole house cooling system 100 includes a return plenum box 101 configured to fit into or replace an existing return air box 122 of the already-installed HVAC air handler system. The return plenum box 101 includes a return box opening 121, a fan opening, and a return duct opening. The return box opening 121 opens to the return air box 122. The fan opening opens to the fan 110. The return duct opening opens to the return air duct 114. An example embodiment fits most standard return air boxes with a 20"×30" size that will fit from 16"×25" to 20"×30" and everything in between. An example embodiment can also be configured in a smaller 14"×30" version, which will fit 12"×25" to 14"×30" and adapts to everything in between. As well known to those of ordinary skill in the art, standard return air boxes 122 can fit between the bottom chords of the ceiling trusses 126 of a structure. Alternatively, the standard return air boxes 122 can fit between the studs in a wall of a structure. In either case, the return plenum box 101 can be retro-fit into or replace the existing return air boxes 122. In an example embodiment, the return plenum box 101 can be coupled to the return air box 122 with a panel bracket 123. As a result, the installation of the whole house cooling system 100 does not require the cutting of a new hole into the ceiling or wall of the structure. The return plenum box 101 with an actuated damper 120 and side-mounted fan 110 provides a whole house cooling system 100 for applications where the construction of the trusses do not allow for a top-mounted fan.

As shown in FIG. 1, the whole house cooling system 100 includes a removable and adjustable fan 110 and a damper 120. The damper 120 is attached to the return plenum box 101 at the damper hinge point 118. The movement of the damper 120 between an open position and a closed position is automated using an actuator 136 and controller 134 provided in the electrical box 130. As illustrated in FIG. 1, the damper 120 is shown in the closed position as indicated by the solid outline of the damper 120. FIG. 1 also shows the position of the damper 120 in the open position as indicated by the dashed outline of the damper 120. In the closed position, the damper 120 blocks air from flowing into the fan opening adjacent to fan 110 through return air box 122. Instead, air flowing from the interior of the structure through return air box 122 and into the return plenum box 101 is directed through the return duct opening, into the filter chamber 115, and into the return air duct 114. The return air duct 114 is typically coupled to the air input side of the already-installed HVAC air handler system. As long as the damper 120 is in the closed position, the HVAC air handler system can re-cycle the air in the structure in a standard manner. An air filter can be removably installed in the filter chamber 115 to filter out particulate material from the recycled air. An example embodiment provides the filter chamber 115 on a side for vertical insertion of air filters and holds up to a 20"×30" air filter. The system will also adapt for an electronic air filter, if desired. The return plenum box 101 includes a no-leak duct collar 112 to which the return air duct 114 can be coupled. An example embodiment will accommodate a return air duct 114 up to a 20" diameter. The standard return air box 122 typically includes a return grille 124 to cover the return air box 122 with a porous covering.

As illustrated in FIG. 1, the damper 120 is shown in the open position as indicated by the dashed outline of the damper 120. The return plenum box 101 is designed for the damper 120 to open at a side while closing off return ducting through return air duct 114. In the open position, the damper 120 blocks air from flowing through return air box 122 and into the return air duct 114 via the return duct opening. Instead, air flowing from the interior of the structure through return air box 122 and into the return plenum box 101 is directed into fan 110 via the fan opening. One or more exhaust fans or other flexible fans 110 can be removably and adjustably installed in a side of the return plenum box 101. In an example embodiment, two individual 2750 cfm (cubic feet per minute) fans can be used or a 3500 cfm fan can be used. The activation and use of the fan(s) 110 can be controlled with a controller 134 in the electrical box 130. The fan(s) 110 can direct an airflow from the return air box 122, through the return plenum box 101, and into an interstitial region (e.g., the attic) of the structure. The increased air pressure in the interstitial region (e.g., the attic) of the structure can cause excess air to be expelled out of the existing air vents to the exterior of the structure. As a result, the air in the interstitial region (e.g., the attic) of the structure is replaced with air pulled from the interior of the structure by use of the fan(s) 110. The replacement of the air in the interstitial region (e.g., the attic) of the structure serves to expel warm air from the structure in the hotter seasons, thereby increasing the efficiency of the air conditioning system in the structure or reducing the amount of time the air conditioning system needs to be active. The replacement of the air in the interstitial region (e.g., the attic) of the structure also serves to expel cool air from the structure in the colder seasons, thereby increasing the efficiency of the heating system in the structure or reducing the amount of time the heating system needs to be active. In the embodiment shown in FIG. 1, the pitch and directionality fan 110 can be adjusted using stabilizer bar 128. As such, the airflow produced by fan 110 can be adjustably directed as desired. As shown in FIG. 3, a 90 degree ducting segment or elbow 127 can be coupled to the output side of the fan 110 to further allow for directional distribution of air in any direction. An example embodiment can include an optional panel that allows for one large fan or two smaller fans. The benefit of this is to allow a user to adjustably distribute the air at a certain angles directly into the attic with one or more fans or attach 90 degree ducting segments 127 to the one or more fans for directional air distribution. All fans can be adjusted up to a 60 degree angle. Brackets for extra stabilization can be installed.

Referring still to FIGS. 1 through 3, the example embodiment of the whole house cooling system 100 includes an electrical box 130, which can include a transformer 132, a circuit board or other form of controller 134, and an actuator 136. In a particular embodiment, the transformer 132 and actuator 136 are 24 volt electrical devices. The transformer 132 and the actuator 136 can move the damper 120 from the closed position to the open position under the command of the controller 134. The damper 120 can be spring-loaded to cause the damper 120 to return to the closed position when the actuator 136 is deactivated or fails. As such, the damper 120 is activated open and spring closed. If the whole house cooling system 100 were to fail, the damper 120 (unenergized) would remain in the closed position and would not affect the HVAC return ductwork.

The controller 134 is configured to include an electrical signal to electrically connect the controller 134 with the HVAC control system. This electrical signal can be installed as a wired or wireless (Bluetooth™ or WIFI) electrical connection. This electrical signal is active when the HVAC system is active and inactive when the HVAC system is inactive. When the HVAC system is active, the active electrical signal received by the controller 134 causes the controller 134 to deactivate the actuator 136, which causes the damper 120 to transition to (or remain in) the closed position. The controller 134 can also deactivate the fan(s) 110 when the active electrical signal is received by the controller 134. In a particular embodiment, a time delay (e.g., 30 seconds) can be electrically enabled to delay the activation of the HVAC system while the controller 134 deactivates the damper 120 and fan(s) 110. While the HVAC system is active, the whole house cooling system 100 is deactivated and the damper 120 remains closed. As a result, the whole house cooling system 100 protects the existing HVAC system by making sure that the HVAC system is not active while the damper 120 is open.

In an example embodiment, the controller 134 is configured to drop, open, or deactivate the R-leg (which is the power, 24 volt line) power connection to the HVAC system whenever the actuator 136 is active. As soon as the HVAC R-leg power connection is deactivated, a 90 second time delay is initiated, which allows the damper 120 to remain closed and the HVAC unit fan to shut off, if unit was running. With controller 134 actively controlling and activating the actuator 136, which causes the damper 120 to transition to an open position, the HVAC unit will not be able to run as long as the R-leg power connection is deactivated. After the controller 134 ceases to actively control and activate the actuator 136, another 90 second time delay is initiated allowing the damper 120 to close and the fan(s) 110 to shut off. Then, the R-leg power connection to the HVAC unit is reactivated allowing the HVAC unit to come back on.

When the HVAC system is idle or inactive, the inactive electrical signal received by the controller 134 causes the controller 134 to activate the actuator 136, which causes the damper 120 to transition to the open position. The controller 134 can also activate the fan(s) 110 when the inactive electrical signal is received by the controller 134. In a particular embodiment, a time delay (e.g., 30 seconds) can be electrically enabled to delay the activation of the whole house cooling system 100 while the HVAC system deactivates. The fan(s) 110 can be energized by a fan relay of the controller 134. Once the controller 134 opens the damper 120 and activates the fan(s) 110, an airflow is produced to pull air from the interior of the structure through the return plenum box 101 and out to the interstitial region (e.g., the attic) of the structure. This action produces the benefits described above. An additional safety switch (normally closed) can connect the controller 134 with a control board of the HVAC system to deactivate the HVAC system control board when the whole house cooling system 100 is active. This additional safety switch deactivates the HVAC system while the whole house cooling system 100 is energized. An example embodiment runs on one 15 amp, 120 volt circuit and is equipped with a 40 va, 24 volt, 120 volt transformer 132 for control voltage.

In another example embodiment, the whole house cooling system 100 of an example embodiment can be configured to be installed with a duct sensing (DS) thermostat 340 (see FIG. 6), a temperature sensor for which can be installed in the interstitial region (e.g., the attic). The DS thermostat can communicate with the controller 134 of the example embodiment to cause the controller 134 to activate or deactivate the fan(s) 110 depending on the temperature in the interstitial region (e.g., the attic) as measured by the temperature sensor of the duct sensing (DS) thermostat 340. During a cooling season, (while the air conditioning system (A/C) is active and attic temperatures rise to the 120 degree range), the DS thermostat can be set to flood the hot attic with air conditioned cool air from the interior of the structure for 10 minutes every 2 to 4 hours, to reduce the heat in the attic. This will, in turn, keep the structure cooler and prevent the air conditioning (A/C) system from cycling as much. By doing this, the temperature in the attic will drop resulting in more heat penetration from the interior of the structure, to the attic, thereby keeping the structure cooler and A/C off. The DS thermostat 340, or a portion thereof, can be installed in the interstitial region (e.g., the attic) to monitor the temperature. When the temperature exceeds 120 degrees (or another user-configured temperature threshold), the controller 134 of the example embodiment can deactivate the central HVAC system and open the damper 120 to block the return duct opening adjacent to the return air duct 114. After a 45 second time delay (or another user-configured time delay), the whole house cooling system 100 of an example embodiment can automatically activate for a pre-configured time period (e.g., 10 minutes) or activate until a pre-configured temperature is reached. Once activated, the whole house cooling system 100 of an example embodiment can blow cool air from the interior of the structure through the attic and purge heat out of the structure through attic vents. This action will reduce the temperature in the structure by a significant amount and without significant energy usage. This process can also be used in the heating season to push heat from the interior of the structure into the cold attic, thus creating a better heat lid over the ceiling. Thus, the whole house cooling system 100 of the example embodiment can make the central HVAC system and the structure more comfortable, efficient, and more cost effective.

An example embodiment can be controlled by a wall mount switch 342 (see FIG. 6) configured to send an electrical signal to the controller 134 to cause the controller 134 to open and close the damper 120 and turn on the fan(s) 110. As described above, the controller 134 and the additional safety switch, included with the whole house cooling system 100, provide the ability to control and prevent the HVAC system from activating at the same time the whole house cooling system 100 is active. An example embodiment provides an adapter to incorporate the wall mount switch 342 into or on an existing thermostat in the structure to control the operation of the whole house cooling system 100. An example embodiment has one wall control, which has a low speed mode that will run one fan and a high speed mode that will run multiple fans simultaneously.

Figure 4:
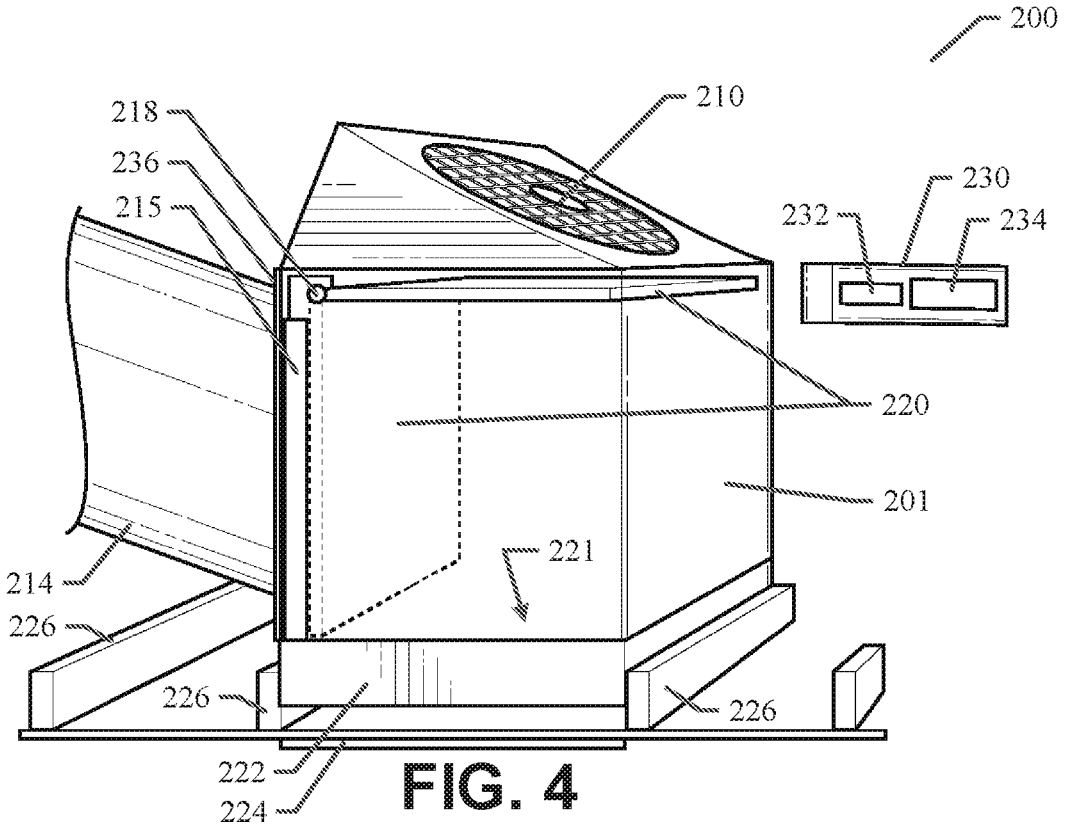
FIGS. 4 through 5 illustrate an example embodiment of the whole house cooling system with a return plenum box, actuated damper, and top-mounted fan.
Figure 5:
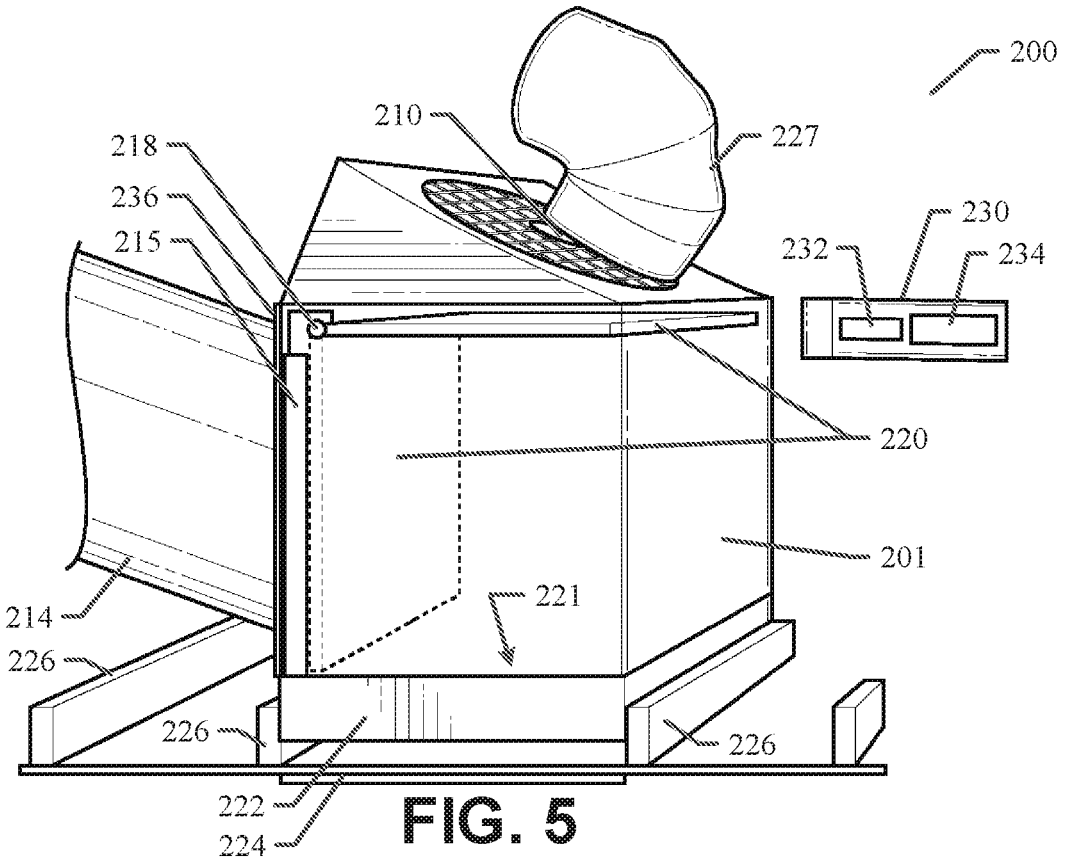

Referring now to FIGS. 4 through 5, an example embodiment of the whole house cooling system 200 with a return plenum box 201, actuated damper 220, and top-mounted fan 210 is illustrated. The illustrated example embodiment is designed for the damper to open at the top when closing off return ducting. The whole house cooling system 200 is convenient for installations where the availability of space may be limited. In a manner similar to the whole house cooling system 100 described above, the whole house cooling system 200 includes a return plenum box 201 configured to fit into or replace an existing return air box 222 of the already-installed HVAC air handler system. The return plenum box 201 includes a return box opening 221, a fan opening, and a return duct opening. The return box opening 221 opens to the return air box 222. The fan opening opens to the fan 210. The return duct opening opens to the return air duct 214. As well known to those of ordinary skill in the art, standard return air boxes 222 can fit between the bottom chords of the ceiling trusses 226 of a structure. Alternatively, the standard return air boxes 222 can fit between the studs in a wall of a structure. In either case, the return plenum box 201 can be retro-fit into or replace the existing return air boxes 222. In an example embodiment, the return plenum box 201 can be coupled to the return air box 222 with a panel bracket. As a result, the installation of the whole house cooling system 200 does not require the cutting of a new hole into the ceiling or wall of the structure. The return plenum box 201 with an actuated damper 220 and top-mounted fan 210 provides a whole house cooling system 200 for applications where the construction of the trusses do not allow for a side-mounted fan.

As shown in FIG. 4, the whole house cooling system 200 includes a removable and adjustable fan 210 and a damper 220. The damper 220 is attached to the return plenum box 201 at the damper hinge point 218. The movement of the damper 220 between an open position and a closed position is automated using an actuator 236 and controller 234 provided in the electrical box 230. As illustrated in FIG. 4, the damper 220 is shown in the closed position as indicated by the solid outline of the damper 220. FIG. 4 also shows the position of the damper 220 in the open position as indicated by the dashed outline of the damper 220. In the closed position, the damper 220 blocks air from flowing into the fan opening adjacent to the fan 210 through return air box 222. Instead, air flowing from the interior of the structure through return air box 222 and into the return plenum box 201 is directed through the return duct opening, into the filter chamber 215 and into the return air duct 214. The return air duct 214 is typically coupled to the air input side of the already-installed HVAC air handler system. As long as the damper 220 is in the closed position, the HVAC air handler system can re-cycle the air in the structure in a standard manner. An air filter can be removably installed in the filter chamber 215 to filter out particulate material from the recycled air. An example embodiment provides the filter chamber 215 on a side for vertical insertion of air filters and holds up to a 20"×30" air filter. The system will also adapt for an electronic air filter, if desired. The return plenum box 201 includes a no-leak duct collar to which the return air duct 214 can be coupled. An example embodiment will accommodate a return air duct 214 up to a 20" diameter. The standard return air box 222 typically includes a return grille 224 to cover the return air box 222 with a porous covering.

As illustrated in FIG. 4, the damper 220 is shown in the open position as indicated by the dashed outline of the damper 220. The return plenum box 201 is designed for the damper 220 to open at the top while closing off return ducting through return air duct 214. In the open position, the damper 220 blocks air from flowing through return air box 222 and into the return duct opening adjacent to the return air duct 214. Instead, air flowing from the interior of the structure through return air box 222 and into the return plenum box 201 is directed into the fan opening adjacent to the fan 210. One or more exhaust fans or other flexible fans 110 can be removably and adjustably installed on the top of the return plenum box 201. In an example embodiment, two individual 2750 cfm (cubic feet per minute) fans can be used or a 3500 cfm fan can be used. The activation and use of the fan(s) 210 can be controlled with a controller 234 in the electrical box 230. The fan(s) 210 can direct an airflow from the return air box 222, through the return plenum box 201, and into an interstitial region (e.g., the attic) of the structure. The increased air pressure in the interstitial region (e.g., the attic) of the structure can cause excess air to be expelled out of the existing air vents to the exterior of the structure. As a result, the air in the interstitial region (e.g., the attic) of the structure is replaced with air pulled from the interior of the structure by use of the fan(s) 210. The replacement of the air in the interstitial region (e.g., the attic) of the structure serves to expel warm air from the structure in the hotter seasons, thereby increasing the efficiency of the air conditioning system in the structure or reducing the amount of time the air conditioning system needs to be active. The replacement of the air in the interstitial region (e.g., the attic) of the structure also serves to expel cool air from the structure in the colder seasons, thereby increasing the efficiency of the heating system in the structure or reducing the amount of time the heating system needs to be active. As shown in FIG. 5, a 90 degree ducting segment or elbow 227 can be coupled to the output side of the fan 210 to allow for directional distribution of air in any direction. An example embodiment can include an optional panel that allows for one large fan or two smaller fans. The benefit of this is to allow a user to adjustably distribute the air at a certain angles directly into the attic with one or more fans or attach 90 degree ducting segments 227 to the one or more fans for directional air distribution.

Referring still to FIGS. 4 through 5, the example embodiment of the whole house cooling system 200 includes an electrical box 230, which can include a transformer 232, a circuit board or other form of controller 234, and an actuator 236. In a particular embodiment, the transformer 232 and actuator 236 are 24 volt electrical devices. The transformer 232 and the actuator 236 can move the damper 220 from the closed position to the open position under the command of the controller 234. The damper 220 can be spring-loaded to cause the damper 220 to return to the closed position when the actuator 236 is deactivated or fails. As such, the damper 220 is activated open and spring closed. If the whole house cooling system 200 were to fail, the damper 220 (unenergized) would remain in the closed position and would not affect the HVAC return ductwork.

The controller 234 is configured to include an electrical signal to electrically connect the controller 234 with the HVAC control system. This electrical signal can be installed as a wired or wireless (Bluetooth™ or WIFI) electrical connection. This electrical signal is active when the HVAC system is active and inactive when the HVAC system is inactive. When the HVAC system is active, the active electrical signal received by the controller 234 causes the controller 234 to deactivate the actuator 236, which causes the damper 220 to transition to (or remain in) the closed position. The controller 234 can also deactivate the fan(s) 210 when the active electrical signal is received by the controller 234. In a particular embodiment, a time delay (e.g., 30 seconds) can be electrically enabled to delay the activation of the HVAC system while the controller 234 deactivates the damper 220 and fan(s) 210. While the HVAC system is active, the whole house cooling system 200 is deactivated and the damper 220 remains closed. As a result, the whole house cooling system 200 protects the existing HVAC system by making sure that the HVAC system is not active while the damper 220 is open.

When the HVAC system is idle or inactive, the inactive electrical signal received by the controller 234 causes the controller 234 to activate the actuator 236, which causes the damper 220 to transition to the open position. The controller 234 can also activate the fan(s) 210 when the inactive electrical signal is received by the controller 234. In a particular embodiment, a time delay (e.g., 30 seconds) can be electrically enabled to delay the activation of the whole house cooling system 200 while the HVAC system deactivates. The fan(s) 210 can be energized by a fan relay of the controller 234. Once the controller 234 opens the damper 220 and activates the fan(s) 210, an airflow is produced to pull air from the interior of the structure through the return plenum box 201 and out to the interstitial region (e.g., the attic) of the structure. This action produces the benefits described above. An additional safety switch (normally closed) can connect the controller 234 with a control board of the HVAC system to deactivate the HVAC system control board when the whole house cooling system 200 is active. This additional safety switch deactivates the HVAC system while the whole house cooling system 200 is energized. An example embodiment runs on one 15 amp, 120 volt circuit and is equipped with a 40 va, 24 volt, 120 volt transformer 232 for control voltage.

An example embodiment can be controlled by a wall mount switch 342 (see FIG. 6) configured to send an electrical signal to the controller 234 to cause the controller 234 to open and close the damper 220 and turn on the fan(s) 210. As described above, the controller 234 and the additional safety switch, included with the whole house cooling system 200, provide the ability to control and prevent the HVAC system from activating at the same time the whole house cooling system 200 is active. An example embodiment provides an adapter to incorporate the wall mount switch 342 into or on an existing thermostat in the structure to control the operation of the whole house cooling system 200. An example embodiment has one wall control, which has a low speed mode that will run one fan and a high speed mode that will run multiple fans simultaneously.

Figure 6:
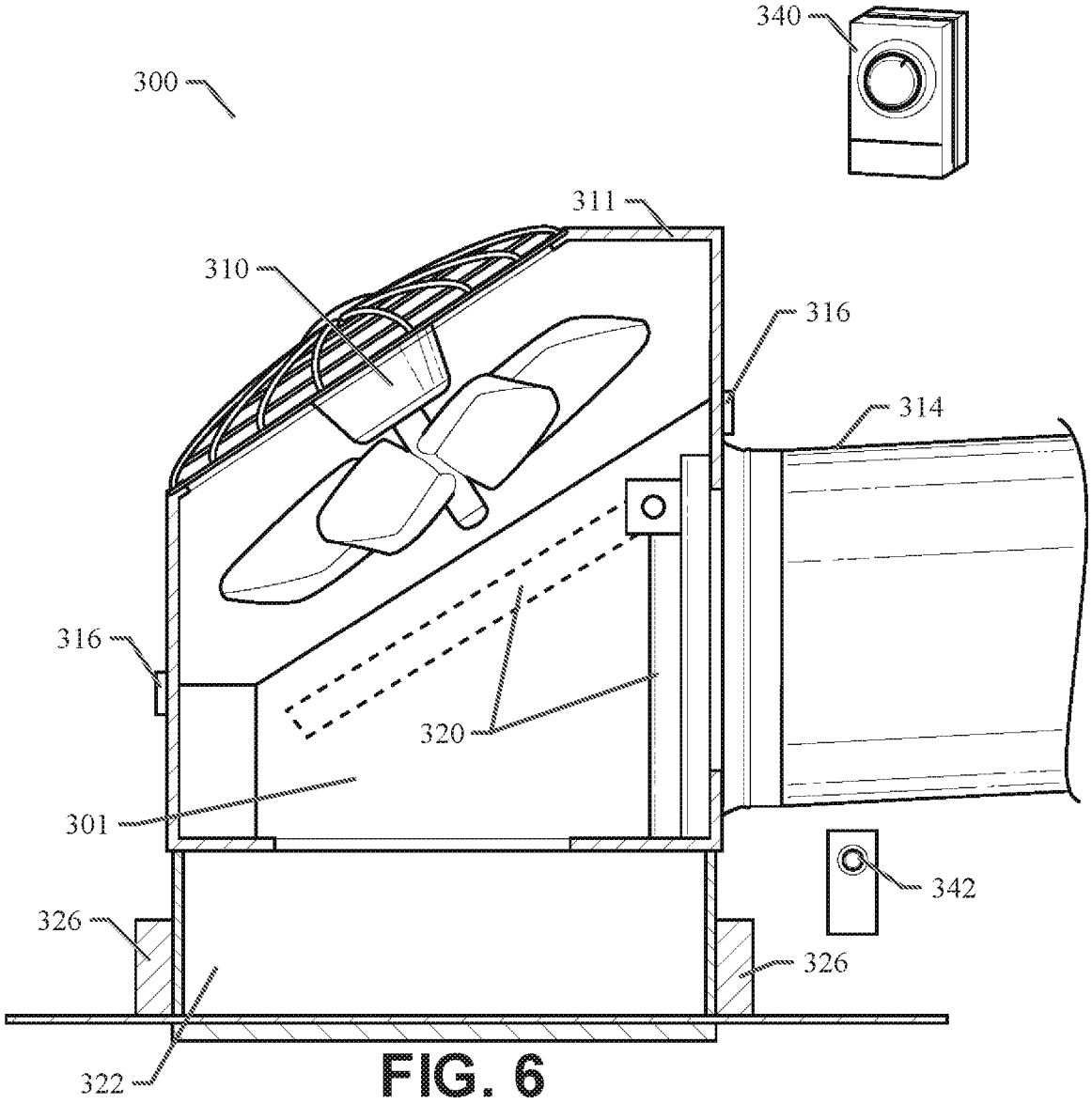
FIGS. 6 through 7 illustrate alternative example embodiments of the whole house cooling system.
Figure 7:
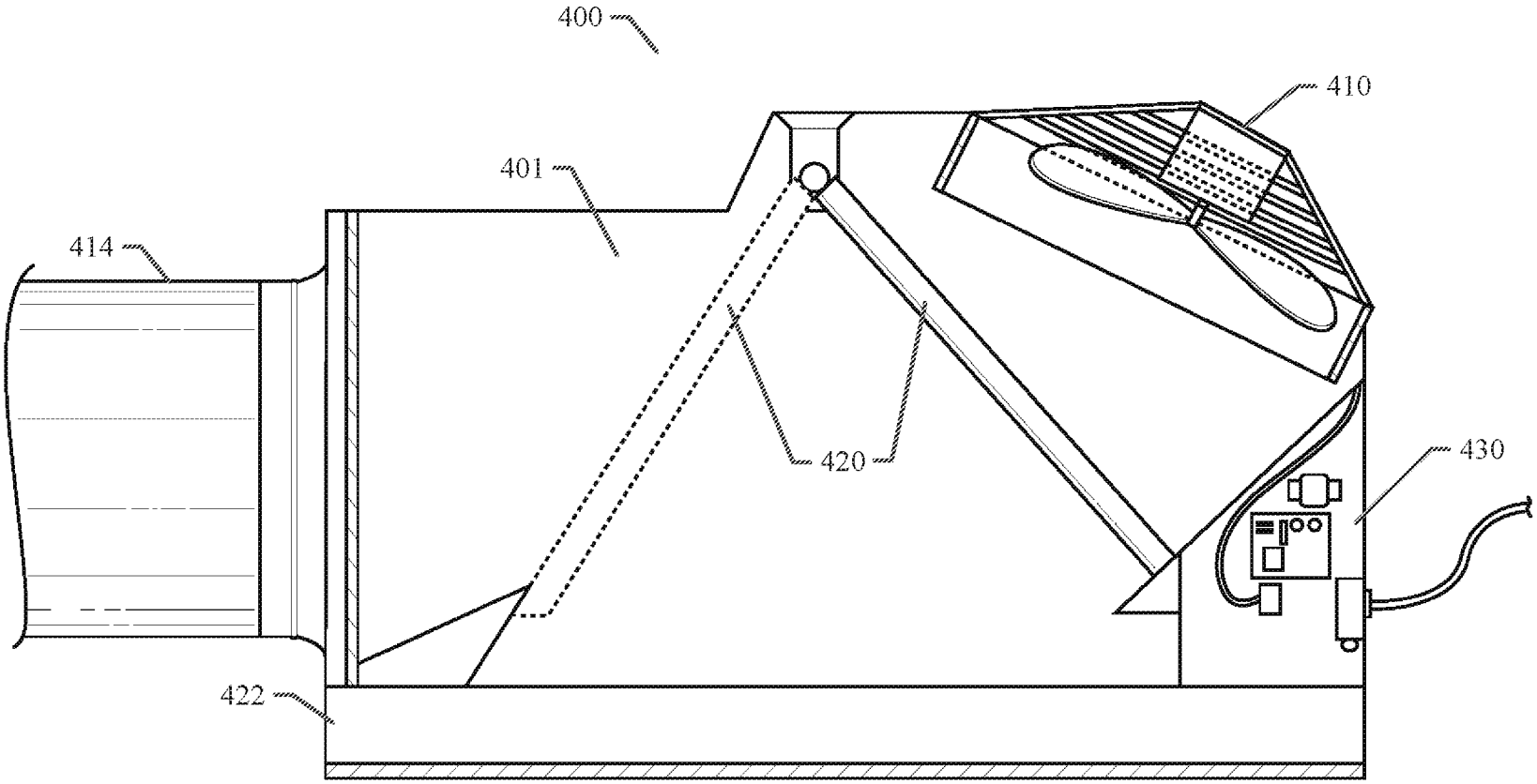

FIGS. 6 through 7 illustrate alternative example embodiments of the whole house cooling system 300/400. Referring now to FIG. 6, an example embodiment of the whole house cooling system 300 with a return plenum box 301, angularly actuated damper 320, and angularly mounted fan 310 is illustrated. The illustrated example embodiment is designed for the damper 320 to open at an angle when closing off return ducting 314. The whole house cooling system 300 is convenient for installations where the availability of space may be limited. In a manner similar to the whole house cooling systems 100 and 200 described above, the whole house cooling system 300 includes a return plenum box 301 configured to fit into or replace an existing return air box 322 of the already-installed HVAC air handler system. As well known to those of ordinary skill in the art, standard return air boxes 322 can fit between the bottom chords of the ceiling trusses 326 of a structure or between the studs in a wall of a structure. In either case, the return plenum box 301 can be retro-fit into or replace the existing return air boxes 322. In an example embodiment, the return plenum box 301 can be coupled to the return air box 322 with apanel bracket. As a result, the installation of the whole house cooling system 300 does not require the cutting of a new hole into the ceiling or wall of the structure. The return plenum box 301 with an angularly actuated damper 320 and angularly mounted fan 310 provides a whole house cooling system 300 for applications where the construction of the trusses do not allow for a side-mounted or top-mounted fan. The whole house cooling system 300 provides a removable fan section 311, which can be removably attached to the return plenum box 301 using fan section attachment clips 316. This feature allows the fan section 311 with fan 310 to be removed from the return plenum box 301 for installation or service. In other respects, the whole house cooling system 300 operates similarly to the whole house cooling systems 100 and 200 described above.

FIG. 7 illustrates another alternative embodiment of the whole house cooling system 400 with a return plenum box 401, angularly actuated damper 420, and angularly mounted fan 410. The illustrated example embodiment is designed for the damper 420 to open at an angle when closing off return ducting 414. The whole house cooling system 400 is convenient for installations where the availability of space may be limited. In a manner similar to the whole house cooling systems 100, 200, and 300 described above, the whole house cooling system 400 includes a return plenum box 401 configured to fit into or replace an existing return air box 422 of the already-installed HVAC air handler system. As well known to those of ordinary skill in the art, standard return air boxes 422 can fit between the bottom chords of the ceiling trusses of a structure or between the studs in a wall of a structure. In either case, the return plenum box 401 can be retro-fit into or replace the existing return air boxes 422. In an example embodiment, the return plenum box 401 can be coupled to the return air box 422 with a panel bracket. As a result, the installation of the whole house cooling system 400 does not require the cutting of a new hole into the ceiling or wall of the structure. The return plenum box 401 with an angularly actuated damper 420 and angularly mounted fan 410 provides a whole house cooling system 400 for applications where the construction of the trusses do not allow for a side-mounted or top-mounted fan. The whole house cooling system 400 also provides an electrical box 430 integrated into the return plenum box 401. In other respects, the whole house cooling system 400 operates similarly to the whole house cooling systems 100, 200, and 300 described above.

Figure 8:
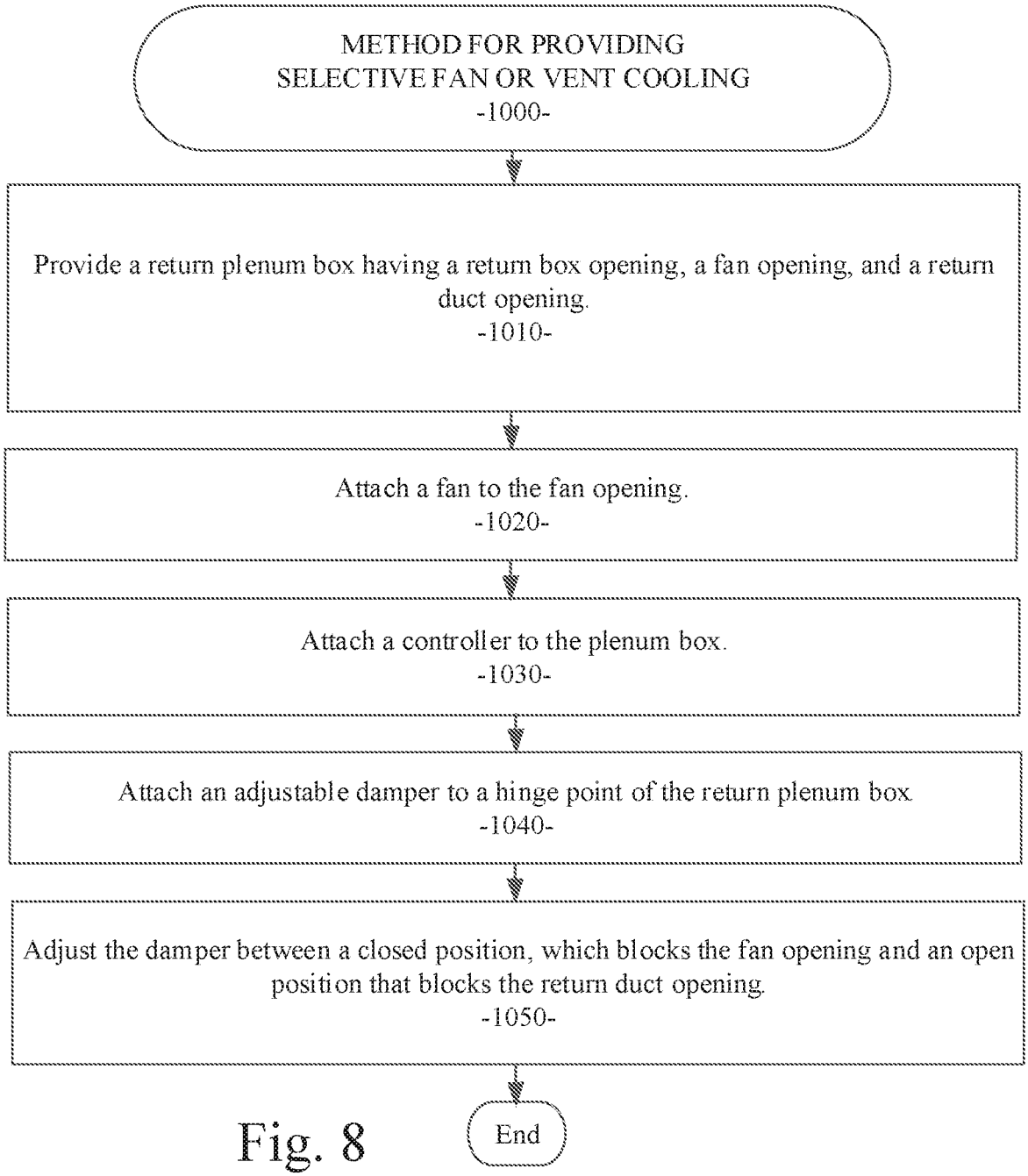
FIG. 8 illustrates a flow diagram representing a sequence of operations performed in a method according to an example embodiment.

FIG. 8 illustrates a flow diagram representing a sequence of operations performed in a method according to an example embodiment. In accordance with the example method 1000, the method comprises: providing a return plenum box having a return box opening, a fan opening, and a return duct opening (operation 1010); attaching a fan to the fan opening (operation 1020); attaching a controller to the plenum box (operation 1030); attaching an adjustable damper to a hinge point of the return plenum box (operation 1040); and adjusting the damper between a closed position, which blocks the fan opening and an open position that blocks the return duct opening (operation 1050).

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used for descriptive purposes only and are not to be construed as limiting. The elements, materials, geometries, dimensions, and sequence of operations may all be varied to suit particular applications. Parts of some embodiments may be included in, or substituted for, those of other embodiments. While the foregoing examples of dimensions and ranges are considered typical, the various embodiments are not limited to such dimensions or ranges.

The Abstract is provided to allow the reader to quickly ascertain the nature and gist of the technical disclosure. The Abstract is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus, the following claims are hereby incorporated into the Detailed Description, with each claim standing on its own as a separate embodiment.

As described herein, an apparatus and method for providing selective fan or vent cooling are disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

What is claimed is:

1. An apparatus comprising:

a plenum box having an incoming aft opening, a fan opening, a fan coupled to the fan opening, a heating, ventilating, and air conditioning (HVAC) duct opening, and an HVAC duct, the HVAC duct opening coupled, via the HVAC duct, to an air input side of an already instated HVAC unit; and an adjustable damper coupled to a hinge point of the plenum box, the damper being adjustable between a closed position which blocks the fan opening, and an open position which blocks the HVAC duct opening, the open position preventing incoming air from flowing from an interior of a structure, through the plenum box, and into the air input side of the already installed HVAC unit;

an actuator for actuating the damper;

a controller;

are R-leg power connection between the controller and the already installed HVAC unit;

the controller coupled to the plenum box, the controller including an R-leg deactivation element to deactivate the R-leg power connection to the already installed HVAC unit thereby disabling the operation of the already installed HVAC unit;

the actuator controlled by the controller to cause the damper to move into the open position only when the R-leg deactivation element has deactivated the R-leg power connection thereby disabling the already installed HVAC unit; and wherein the controller signals the fan to operate when the damper is in the open position.

2. The apparatus of claim 1 wherein the fan is side-mounted to the plenum box.

3. The apparatus of claim 1 wherein the fan is top-mounted to the plenum box.

4. The apparatus of claim 1 wherein the plenum box fits an already-Installed incoming air box.

5. The apparatus of claim 1 wherein the actuator is controlled by the controller to adjust the damper between the open position and the closed position.

6. The apparatus of claim 1 wherein the damper actuator is spring-loaded to cause the damper to return to the closed position if the R-leg power connection is deactivated.

7. The apparatus of claim 1 including a wall switch configured to control operation of the controller.

8. The apparatus of claim 1 including a directional ducting segment to direct air flow from the fan.

9. A method comprising:

providing a plenum box having an incoming air opening, a fan opening, a heating, ventilating, and air conditioning (HVAC) duct opening, and an HVAC duct, coupling the plenum box at the HVAC duct opening, via the HVAC duct, to an air input side of an already installed HVAC unit;

attaching a fan to the fan opening;

attaching an R-leg power connection between a controller and the already installed HVAC unit, attaching the controller to the plenum box, the controller including an R-leg deactivation element to deactivate the R-leg power connection to the already installed HVAC unit;

attaching an actuator and an adjustable damper to a hinge point of the plenum box, adjusting the damper being between a closed position which blocks the fan opening, and an open position which blocks the HVAC duct opening and prevents incoming air from flowing from an interior of a structure, through the plenum box, and into the air input side of the already installed HVAC unit; and signaling the fan to operate and moving the damper, by using the actuator controlled by the controller, into the open position only when the R-leg deactivation element deactivates the R-leg power connection to the already installed HVAC unit thereby disabling the already installed HVAC unit.

10. The method of claim 9 wherein the fan is side-mounted to the return plenum box.

11. The method of claim 9 wherein the fan is top-mounted to the plenum box.

12. The method of claim 9 wherein the plenum box fits an already-installed incoming air box.

13. The method of claim 9 including using the actuator controlled by the controller to adjust the damper between the open position and the closed position.

14. The method of claim 9 wherein the damper actuator is spring-loaded to cause the damper to return to the closed position if the R-leg power connections is deactivated.

15. The method of claim 9 including providing a wall switch configured to control operation of the controller.

16. The method of claim 9 including providing a directional ducting segment to direct air flow from the fan.

* * * * *